US010000868B2

(12) United States Patent
Senda et al.

(10) Patent No.: US 10,000,868 B2
(45) Date of Patent: Jun. 19, 2018

(54) REINFORCING CORD FOR RUBBER AND RUBBER PRODUCT USING THE SAME

(75) Inventors: Osamu Senda, Tokyo (JP); Tomonori Nakashima, Tokyo (JP)

(73) Assignees: Zeon Corporation, Tokyo (JP); Nippon Sheet Glass Company, Limited, Tokyo (JP)

( * ) Notice: Subject to any disclaimer, the term of this patent is extended or adjusted under 35 U.S.C. 154(b) by 293 days.

(21) Appl. No.: 13/978,087

(22) PCT Filed: Jan. 20, 2012

(86) PCT No.: PCT/JP2012/000355
§ 371 (c)(1),
(2), (4) Date: Jul. 2, 2013

(87) PCT Pub. No.: WO2012/098910
PCT Pub. Date: Jul. 26, 2012

(65) Prior Publication Data

US 2013/0281604 A1 Oct. 24, 2013

(30) Foreign Application Priority Data

Jan. 21, 2011 (JP) ..... 2011-010448

(51) Int. Cl.
*D02G 3/44* (2006.01)
*D06M 15/285* (2006.01)
(Continued)

(52) U.S. Cl.
CPC ..... *D02G 3/447* (2013.01); *D06M 15/285* (2013.01); *D06M 15/31* (2013.01); *D06M 15/41* (2013.01);
(Continued)

(58) Field of Classification Search
CPC .... D02G 3/447; D06M 15/285; D06M 15/31; D06M 15/41; D06M 15/693; Y02T 428/292; Y02T 428/2933
(Continued)

(56) References Cited

U.S. PATENT DOCUMENTS 5,651,995 A 7/1997 Oyama et al.
5,861,212 A * 1/1999 Mori et al. ..... 428/375
2010/0221520 A1 9/2010 Tai et al.

FOREIGN PATENT DOCUMENTS

CN 101790608 A 7/2010
EP 0704459 A1 4/1996
(Continued)

OTHER PUBLICATIONS

International Search Report, PCT/JP2012/000355, dated Mar. 22, 2012 (2 pages).
(Continued)

*Primary Examiner* — Josephine L Chang
(74) *Attorney, Agent, or Firm* — Reza Mollaaghababa; Thomas J. Engellenner; Pepper Hamilton LLP

(57) ABSTRACT

Provided are a reinforcing cord using a reinforcing fiber treating agent for improving the performance, particularly oil resistance, of rubber products, and a highly oil-resistant rubber product. By using a reinforcing fiber treating agent that has an α,β-ethylenically unsaturated nitrile monomer unit content of 30-55 wt %, an acid group-containing α,β-ethylenically unsaturated monomer unit content of 3-20 wt %, an iodine value of 120 or less and a tetrahydrofuran insoluble fraction of 30 wt % or more, the oil resistance of the reinforcing cord and thus the oil resistance of rubber products using the reinforcing cord are improved.

4 Claims, 1 Drawing Sheet

(51) Int. Cl.
*D06M 15/31* (2006.01)
*D06M 15/41* (2006.01)
*D06M 15/693* (2006.01)

(52) U.S. Cl.
CPC ..... *D06M 15/693* (2013.01); *Y10T 428/292* (2015.01); *Y10T 428/2933* (2015.01)

(58) Field of Classification Search
USPC ..... 428/375, 368; 524/521
See application file for complete search history.

(56) References Cited

FOREIGN PATENT DOCUMENTS

| | | | |
|---|---|---|---|
| EP | 1762654 | A1 | 3/2007 |
| JP | 63270877 | A | 11/1988 |
| JP | 1153741 | A | 6/1989 |
| JP | 1203731 | A | 8/1989 |
| JP | 8100025 | A | 4/1996 |
| JP | 2011012132 | A | 1/2011 |
| WO | 2006/001385 | A1 | 1/2006 |

OTHER PUBLICATIONS

English Translation of Office Action in corresponding Chinese App. No. 2012800060228 dated Aug. 28, 2014 (8 pages).

* cited by examiner

REINFORCING CORD FOR RUBBER AND RUBBER PRODUCT USING THE SAME

CROSS-REFERENCE TO RELATED APPLICATION

This application claims priority to Japanese Patent Application No. 2011-10448, filed on Jan. 21, 2011, the disclosure of which is hereby incorporated by reference in its entirety.

TECHNICAL FIELD

The present invention relates to reinforcing cord for reinforcing rubber product and rubber product using the same.

BACKGROUND ART

Belts for automobiles, such as timing belts, poly ribbed belts, wrapped belts and V-belts, are composed of a complex of reinforcing cords and matrix rubber (a rubber-fiber complex). Conventionally, chloroprene rubber (CR) and acrylonitrile-butadiene copolymer rubber (NBR), which are oil resistant rubber, have been mainly used as matrix rubber. However, to cope with an increasing demand for heat resistance with the need to comply with emission regulations for automobiles, reduce the size of engine rooms for reducing the weight of automobiles, insulate engine compartments for better noise control, and so on, such nitrile group-containing highly saturated copolymer rubber that balances heat resistance and oil resistance has been commercially available.

Generally, a reinforcing cord is formed by a band of reinforcing fibers, each having a coating on the surface thereof for protecting the surface of the reinforcing fiber and increasing adhesiveness to the matrix rubber. To form this coating, a mixture of a resorcin-formaldehyde condensate and latex (which may be referred to hereinafter as "RFL") is commonly used. For example, JP 63-270877 A (PTL 1) discloses a reinforcing cord with increased adhesiveness to the matrix rubber. In this reinforcing cord, a coating is formed on the surface of each reinforcing fiber constituting the reinforcing cord. The coating is obtained by applying, drying and curing a mixture of a resorcin-formaldehyde condensate and a latex of hydrogenated nitrile rubber (H-NBR) on the surface of reinforcing fiber.

However, a timing belt using this reinforcing cord with coatings, which are formed by applying, drying and curing a mixture of a resorcin-formaldehyde condensate and a latex of hydrogenated nitrile rubber (H-NBR), has poor oil resistance at the boundaries between the reinforcing cord and the matrix rubber, i.e., at the coatings on the reinforcing fibers constituting the reinforcing cord when used as an in-oil belt of an automobile, resulting in insufficient oil resistance of the in-oil belt.

CITATION LIST

Patent Literature

PTL 1: JP 63-270877 A

SUMMARY OF INVENTION

Technical Problem

Therefore, an object of the present invention is to provide a reinforcing cord used for rubber and using a latex of a highly saturated nitrile rubber capable of forming a coating with excellent oil resistance, and a rubber product using the rubber reinforcing cord.

Solution to Problem

To achieve the aforementioned object, the inventors of the present invention made intensive studies on a highly saturated nitrile rubber constituting a latex, which is an ingredient of a treating agent forming a coated layer. As a result, the inventors obtained a finding that the above-described properties are improved by using a latex of a highly saturated nitrile rubber having a tetrahydrofuran insoluble fraction within a particular range, and accomplished the present invention based on this finding.

Thus, the present invention provides a reinforcing cord that uses a latex of a highly saturated nitrile rubber as a coating, in which the highly saturated nitrile rubber has an α,β-ethylenically unsaturated nitrile monomer unit content of 30 wt % to 55 wt %, an acid group-containing α,β-ethylenically unsaturated monomer unit content of 3 wt % to 20 wt %, an iodine value of 120 or less, and a tetrahydrofuran insoluble fraction of 30 wt % or more.

The present invention also provides a rubber product with excellent oil resistance using the above-described reinforcing cord.

The coating of the present invention preferably contains at least one cross-linking agent selected from a maleimide-based cross-linking agent, polyisocyanate compound, quinonedioxime-based cross-linking agent, and aromatic nitroso compound.

Advantageous Effect of Invention

Since the reinforcing cord of the present invention has a coating with excellent oil resistance, by using this reinforcing cord as a reinforcing member, such a rubber product can be obtained that has excellent oil resistance and is useful for oil-contacting members used in automobiles or the like, in particular, in-oil belts.

DESCRIPTION OF EMBODIMENTS

Figure 1:
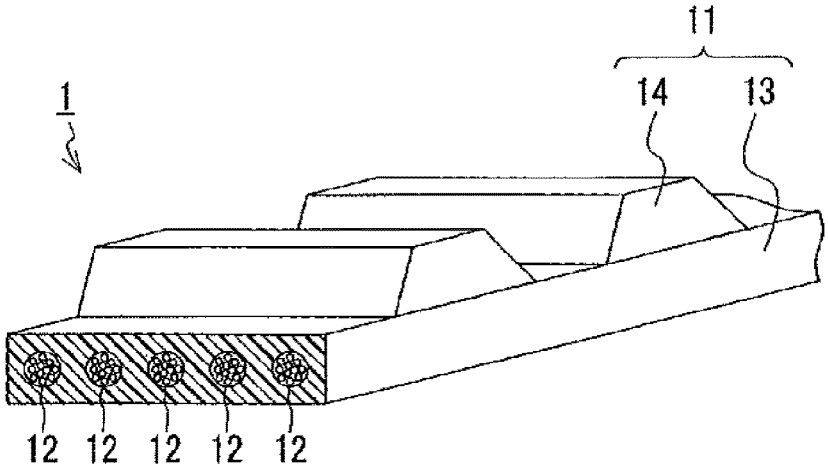
FIG. 1 is a diagram illustrating the internal structure of a toothed belt using the reinforcing cord of the present invention.

A highly saturated nitrile rubber constituting a latex of a highly saturated nitrile rubber of the present invention has an α,β-ethylenically unsaturated nitrile monomer unit content of 30 wt % to 55 wt %, an acid group-containing α,β-ethylenically unsaturated monomer unit content of 3 wt % to 20 wt %, an iodine value of 120 or less, and a tetrahydrofuran insoluble fraction of 30 wt % or more.

Without any particular limitation, α,β-ethylenically unsaturated nitrile monomers forming the α,β-ethylenically unsaturated nitrile monomer units preferably have 3 to 18 carbon atoms and particularly preferably have 3 to 9 carbon atoms. Specific examples of such monomers include acrylonitrile, methacrylonitrile, α-chloroacrylonitrile, and so on; among these, preferred is acrylonitrile.

These α,β-ethylenically unsaturated nitrile monomers may be used alone or in combination of two or more thereof.

The α,β-ethylenically unsaturated nitrile monomer unit content in the highly saturated nitrile rubber needs to be in the range of 30 wt % to 55 wt %, preferably in the range of 32 wt % to 45 wt %. If the α,β-ethylenically unsaturated nitrile monomer unit content is too small, the nitrile rubber may become less oil resistant, or, conversely, if the content is too large, the nitrile rubber may become less cold resistant.

Acid group-containing α,β-ethylenically unsaturated monomers forming the acid group-containing α,β-ethylenically unsaturated monomer units are monomers, each containing an α,β-ethylenically unsaturated bond and an acid group in the molecule. Without any particular limitation, the acid group may be any of carboxyl group, sulfonate group, phosphate group, and so on; among these, preferred is carboxyl group. The acid group-containing α,β-ethylenically unsaturated monomers preferably have 3 to 18 carbon atoms, and particularly preferably have 3 to 9 carbon atoms.

Examples of the acid group-containing monomers having a carboxyl group include an α,β-ethylenically unsaturated monocarboxylic acid, α,β-ethylenically unsaturated dicarboxylic acid, α,β-ethylenically unsaturated dicarboxylic acid monoester, as well as α,β-ethylenically unsaturated dicarboxylic anhydride that can be transformed to a compound having a carboxyl group.

Examples of the α,β-ethylenically unsaturated monocarboxylic acid include acrylic acid, methacrylic acid, ethacrylic acid, crotonic acid, cinnamic acid, and so on.

Examples of the α,β-ethylenically unsaturated dicarboxylic acid include maleic acid, fumaric acid, itaconic acid, citraconic acid, chloromaleic acid, and so on.

Examples of the α,β-ethylenically unsaturated dicarboxylic acid monoester include monomethyl maleate, monoethyl maleate, monobutyl maleate, monocyclohexyl maleate, monomethyl fumarate, monoethyl fumarate, monobutyl fumarate, mono-2-hydroxyethyl fumarate, monocyclohexyl fumarate, monomethyl itaconate, monoethyl itaconate, monobutyl itaconate, and so on.

Examples of the α,β-ethylenically unsaturated dicarboxylic anhydride include maleic anhydride, itaconic anhydride, citraconic anhydride, and so on.

The acid group-containing α,β-ethylenically unsaturated monomer unit content in the highly saturated nitrile rubber needs to be in the range of 3 wt % to 20 wt %, preferably in the range of 3 wt % to 10 wt %.

The acid group-containing α,β-ethylenically unsaturated monomer may be copolymerized within the above-described range to provide improved adhesiveness and wear resistance.

From the viewpoint of improving adhesiveness by means of rubber elasticity, it is preferable that the highly saturated nitrile rubber has diene monomer units and/or α-olefin monomer units. Dienes forming the diene monomer units include conjugated dienes having at least 4 carbon atoms, such as 1,3-butadiene, isoprene, 2,3-dimethyl-1,3-butadiene and 1,3-pentadiene; and non-conjugated dienes having 5 to 12 carbon atoms, such as 1,4-pentadiene and 1,4-hexadiene. Among these preferred are conjugated dienes and more preferred is 1,3-butadiene.

α-olefins forming the α-olefin monomer units preferably have 2 to 12 carbon atoms, and include ethylene, propylene, 1-butene, 4-methyl-1-pentene, 1-hexene, 1-octene, and so on.

The diene monomer unit content and/or α-olefin monomer unit content in the highly saturated nitrile rubber is preferably in the range of 25 wt % to 67 wt %, and particularly preferably in the range of 45 wt % to 65 wt %.

The highly saturated nitrile rubber may also be obtained by copolymerization of α,β-ethylenically unsaturated nitrile monomers, acid group-containing α,β-ethylenically unsaturated monomers, and furthermore, monomers copolymerizable with dienes and/or α-olefins (which will be referred to as the "other comonomers").

The other comonomer unit content in the highly saturated nitrile rubber is preferably 0 wt % to 10 wt %.

The other comonomers include aromatic vinyl, α,β-ethylenically unsaturated monocarboxylic acid esters, fluoroolefins, copolymerizable anti-aging agents, and so on.

The aromatic vinyl includes styrene and styrene derivatives having 8 to 18 carbon atoms. Specific examples of the aromatic vinyl include α-methylstyrene, vinylpyridine, and so on.

The α,β-ethylenically unsaturated monocarboxylic acid esters are esters of α,β-ethylenically unsaturated monocarboxylic acids and aliphatic alcohols having 1 to 12 carbon atoms; specific examples thereof include methyl(meth)acrylate, butyl(meth)acrylate, methoxyethyl(meth)acrylate, trifluoroethyl(meth)acrylate, tetrafluoropropyl(meth)acrylate, and so on.

The fluoroolefins are unsaturated fluorine compounds having 2 to 12 carbon atoms; specific examples thereof include difluoroethylene, tetrafluoroethylene, fluoroethylene vinyl ether, fluoropropyl vinyl ether, o-trifluoromethylstyrene, vinyl pentafluorobenzoate, and so on.

Specific examples of the copolymerizable anti-aging agents include N-(4-anilinophenyl)acrylamide, N-(4-anilinophenyl)methacrylamide, N-(4-anilinophenyl)cinnamamide, N-(4-anilinophenyl)crotonamide, N-phenyl-4-(3-vinylbenzyloxy)aniline, N-phenyl-4-(4-vinylbenzyloxy) aniline, and so on.

Self-crosslinkable monomer units may optionally exist in the highly saturated nitrile rubber. The existence of self-crosslinkable monomer units may improve water resistance.

Specific examples of self-crosslinkable monomers forming the self-crosslinkable monomer units include N-methylol(meth)acrylamide, N,N'-dimethylol(meth)acrylamide, (meth)acrylamide, N-methoxymethyl(meth)acrylamide, N-ethoxymethyl(meth)acrylamide, N-butoxymethyl(meth) acrylamide, N,N'-methylenebisacrylamide, and so on. In particular, the N-methylol(meth)acrylamide having an N-methylol group is preferred from the viewpoint of improving the wear resistance of a rubber product using a reinforcing cord having coatings formed thereon by means of a treating agent which uses the latex of the present invention (which will be referred to as the "aqueous treating agent").

The self-crosslinkable monomer unit content in the highly saturated nitrile rubber is preferably in the range of 0 wt % to 20 wt %, and more preferably in the range of 0 wt % to 10 wt %. An excessively large self-crosslinkable monomer unit content is not preferable because it impairs the flexibility of the rubber product using the reinforcing cord having coatings formed thereon by means of the aqueous treating agent of the present invention.

The highly saturated nitrile rubber used in the present invention has a Mooney viscosity ($ML_{1+4}$, at 100° C.) of preferably 10 to 300, more preferably 20 to 250, and particularly preferably 30 to 200. A too low Mooney viscosity may lead to degradation in the mechanical properties of the rubber product using the reinforcing cord having coatings formed thereon by means of the aqueous treating agent of the present invention.

The highly saturated nitrile rubber constituting the latex of the present invention is obtained by copolymerizing the above-mentioned monomers, and, optionally, hydrogenating the carbon-carbon double bond in the resulting copolymer.

The polymerization method is not limited to a specific one, and so any well-known method such as emulsion polymerization or solution polymerization can be used. However, emulsion polymerization is preferred in terms of industrial productivity.

As an emulsion polymerization method, any conventionally well-known method may be employed.

Generally, used as an emulsifier for use in polymerization may be an anionic surfactant, cationic surfactant, nonionic surfactant, amphoteric surfactant, and so on. Among these preferred is an anionic surfactant, which has no limitation on the amount used. However, in terms of the adhesiveness of the aqueous treating agent obtained from this latex, the anionic surfactant is to be used in amounts of 1 to 10 parts by weight, preferably 2 to 6 parts by weight, per 100 parts by weight of the total monomers. In addition, any polymerization initiators and the like that are commonly used may be employed.

Further, the polymerization scheme is also not limited to a specific mode and may be either batch, semi-batch or continuous. There is also no limitation on polymerization temperature or pressure.

The latex of the highly saturated nitrile rubber of the present invention is preferably obtained by subjecting a nitrile rubber latex obtained by emulsion polymerization to a hydrogenation process. Hydrogenation may not necessarily be performed if the nitrile rubber has a low conjugated diene monomer unit content, and thus, the iodine value of the nitrile rubber resulting from emulsion polymerization is smaller than a desired value.

Additionally, the latex thus obtained preferably has an average grain size of 0.01 μm to 0.5 μm. Moreover, the latex preferably has a solid content concentration of 50 wt % or less, and particularly preferably 5 wt % to 50 wt % for preventing agglomeration.

The degree of hydrogenation, i.e., the iodine value of the highly saturated nitrile rubber needs to be 120 or less, preferably to be 80 or less, more preferably to be 60 or less, and particularly preferably to be 30 or less. A too high iodine value may deteriorate the heat aging resistance and ozone resistance of coatings that are formed by curing the aqueous treating agent of the present invention.

Hydrogenation may be performed in accordance with a well-known method, preferably by using aqueous-phase hydrogenation in which the nitrile rubber latex obtained from emulsion polymerization is directly subjected to hydrogenation, although the latex obtained by polymerization may be hydrogenated in oil phase after having been solidified.

In hydrogenating the nitrile rubber by aqueous-phase hydrogenation, the nitrile rubber latex prepared by emulsion polymerization is preferably subjected to hydrogenation reaction while being diluted with water, if necessary.

The aqueous-phase hydrogenation includes aqueous-phase direct hydrogenation in which hydrogen is supplied to a reaction system in the presence of a hydrogenation catalyst to perform hydrogenation, and aqueous-phase indirect hydrogenation in which hydrogenation is performed through reduction in the presence of an oxidizer, reducing agent and activator. The former is more preferable.

Any compounds may be used as the hydrogenation catalyst without any particular limitation as long as they have a low degradability in water. Specific examples of such compounds include, as palladium catalysts, palladium salts of carboxylic acids such as formic acid, propionic acid, lauric acid, succinic acid, oleic acid, phthalic acid or the like; palladium chlorides such as palladium chloride, dichloro(cyclooctadiene)palladium, dichloro(norbornadiene)palladium, ammonium hexachloropalladate (IV) or the like; iodides such as palladium iodide; palladium sulfate-dihydrates, and so on.

Among these particularly preferred are palladium salts of carboxylic acids, dichloro(norbornadiene)palladium and ammonium hexachloropalladate (IV). While the amount of the hydrogenation catalyst used may be determined in an appropriate manner, it is preferably 5 to 6,000 ppm by weight, more preferably 10 to 4,000 ppm by weight relative to the nitrile rubber.

The reaction temperature in the aqueous-phase direct hydrogenation is preferably 0° C. to 300° C., more preferably 20° C. to 150° C., and particularly preferably 30° C. to 100° C.

A too low reaction temperature may result in a lower reaction rate, whereas a too high reaction temperature may cause a side reaction such as hydrogenation of a nitrile group.

The hydrogen pressure is preferably 0.1 MPa to 30 MPa, and more preferably 0.5 MPa to 20 MPa.

The reaction time is preferably 1 to 15 hours, and particularly preferably 2 to 10 hours.

In the aqueous-phase direct hydrogenation, upon completion of the hydrogenation reaction, the hydrogenation catalyst is usually removed from the latex. However, the hydrogenation catalyst may also be left in the latex without being removed.

A method for removing the hydrogenation catalyst may involve, for example, adding an adsorbent, such as activated carbon and ion-exchange resin, to the latex under stirring to thereby allow the hydrogenation catalyst to be adsorbed to the adsorbent, and then subjecting the latex to filtration or centrifugation. In addition, the hydrogenation catalyst may be removed by adding hydrogen peroxide and dimethylglyoxime to the latex after completion of the hydrogenation reaction, followed by warming and stirring the resulting latex with an adjusted pH of 8 to 11 so as to precipitate insoluble matters (including the hydrogenation catalyst) in the latex, and removing the insoluble matters from the latex.

In the aqueous-phase indirect hydrogenation, a solid content concentration of the nitrile rubber latex is preferably 1 wt % to 50 wt %, and more preferably 1 wt % to 40 wt %.

As an oxidizer, oxygen, air, hydrogen peroxide and so on are used.

The oxidizer is used in an amount such that the molar ratio of the oxidizer to the carbon-carbon double bond (oxidizer/carbon-carbon double bond) is preferably 0.1:1 to 100:1, and more preferably 0.8:1 to 5:1.

As a reducing agent, hydrazines such as hydrazine, hydrazine hydrate, hydrazine acetate, hydrazine sulfate or hydrazine hydrochloride, or compounds liberating hydrazine are used.

The reducing agent is used in an amount such that the molar ratio of the reducing agent to the carbon-carbon double bond (reducing agent/carbon-carbon double bond) is preferably 0.1:1 to 100:1, and more preferably 0.8:1 to 5:1.

As an activator, ions of metal such as copper, iron, cobalt, lead, nickel, iron and tin are used.

The activator is used in an amount such that the molar ratio of the activator to the carbon-carbon double bond (activator/carbon-carbon double bond) is preferably 1:1,000 to 10:1, and more preferably 1:50 to 1:2.

A hydrogenation reaction in the aqueous-phase indirect hydrogenation is carried out at temperatures from 0° C. to the reflux temperature, preferably 0° C. to 250° C., more preferably 20° C. to 100° C., and particularly preferably 40° C. to 80° C.

The highly saturated nitrile rubber needs to have a tetrahydrofuran insoluble fraction of 30 wt % or more.

The tetrahydrofuran insoluble fraction is preferably 35 wt % to 95 wt %, more preferably 45 wt % to 90 wt %, and even more preferably 50 wt % to 80 wt %.

As used herein, the tetrahydrofuran insoluble fraction represents the percent by weight of the insoluble fraction amount after the highly saturated nitrile rubber has been immersed and left in tetrahydrofuran (THF) at 25° C. for 48 hours, relative to the highly saturated nitrile rubber amount before that THF immersion.

A too small tetrahydrofuran insoluble fraction will deteriorate the oil resistance of coatings formed by curing the aqueous treating agent, as well as the oil resistance of a rubber product obtained by using a reinforcing cord with these coatings formed thereon.

The tetrahydrofuran insoluble fraction of the highly saturated nitrile rubber is adjusted in such a way that the amount of a molecular weight modifier and the final polymerization conversion rate are controlled to fall within a predetermined range at the time of polymerization. Specifically, the molecular weight modifier is used in an amount of 0.25 to 0.55 parts by weight, preferably 0.35 to 0.48 parts by weight, per 100 parts by weight of total monomer, and the final polymerization conversion rate is controlled to be 88% to 92%. A preferred molecular weight modifier is t-dodecylmercaptan.

The reinforcing cord of the present invention comprises reinforcing fibers and coatings formed on the surfaces of the reinforcing fibers. This coating is a film that is formed by applying and curing the aqueous treating agent on the reinforcing fiber.

The reinforcing fibers and the aqueous treating agent used for forming coatings provided on the surfaces of the reinforcing fibers in the reinforcing cord of the present invention will now be described in detail below.

The reinforcing fibers used in the reinforcing cord of the present invention may be of any type and shape without any particular limitation, as long as they enhance the shape stability and strength of the resulting rubber product when embedded in the matrix rubber of the rubber product. For example, glass fibers, polyvinyl alcohol fibers represented by vinylon fibers, polyester fibers, polyamide fibers such as Nylon or aramid (aromatic polyamide), carbon fibers, polyparaphenylene benzoxazole fibers, and so on are available. A composite fiber including glass fibers and a carbon fiber twisted together may also be used, as disclosed in WO 2004/090224. Among these preferably used are glass fibers that are excellent in both heat resistance and tensile strength.

The reinforcing fibers are not limited to a particular form as long as they can be embedded into a matrix rubber; specific examples thereof may include staples, filaments, cord-like form, rope-like form, and so on.

An aqueous treating agent used for forming coatings on the surfaces of the reinforcing fibers constituting the reinforcing cord of the present invention contains the above-described latex of the highly saturated nitrile rubber of the present invention.

While this aqueous treating agent contains the above-described latex of the highly saturated nitrile rubber as an essential component, it is desirable that the agent further contains an additive for curing the latex. Examples of the additive used include resin and cross-linking agents.

As resin, resorcin-formaldehyde resin, melamine resin, epoxy resin and isocyanate resin may be suitably used; among these preferred is resorcin-formaldehyde resin.

Examples of cross-linking agents include, for example, quinonedioxime-based cross-linking agents such as P-quinonedioxime, (meth)acrylate-based cross-linking agents such as lauryl(meth)acrylate and methyl(meth)acrylate, allyl-based cross-linking agents such as DAF (diallyl fumarate), DAP (diallyl phthalate), TAC (triallyl cyanurate) and TAIC (triallyl isocyanurate), maleimide-based cross-linking agents such as bismaleimide, phenyl maleimide and N,N-m-phenylenedimaleimide, aromatic or aliphatic organic diisocyanate, polyisocyanate compounds such as polyisocyanate, aromatic nitroso compounds, sulfur, or the like. These cross-linking agents may be used alone or in combination. The cross-linking agents are selected considering the latex contained in the aqueous treating agent, the type of matrix rubber to which the reinforcing cord is embedded, and so on. In addition, it is preferable that the cross-linking agents are water dispersions in terms of homogeneous presence in the aqueous treating agent.

It is desirable to use a cross-linking agent for the aqueous treating agent used in the reinforcing cord for use in rubber products such as timing belts. As illustrated in WO 2006/001385, when an aqueous treating agent containing resin is applied to reinforcing fibers constituting a reinforcing cord, the reinforcing fibers are merely brought into contact with, rather than bonded, one another, considering a coating forming reaction that would proceed with heat treatment. Accordingly, gaps may be formed among the reinforcing fibers in the reinforcing cord when the resulting rubber product is bent, resulting in a reduction in the strength of the reinforcing cord. In contrast, when an aqueous treating agent containing a cross-linking agent is used, coatings are formed over multiple reinforcing fibers, which in turn are in close contact with one another via the coatings. Accordingly, there may be no gaps among the reinforcing fibers even when the rubber product using this reinforcing cord is bent, resulting in a high-strength rubber product.

Preferred among the cross-linking agents exemplified above is at least one cross-linking agent selected from a maleimide-based cross-linking agent, polyisocyanate and an aromatic nitroso compound. Among these, a maleimide-based cross-linking agent is suitably used, and diphenylmethane-4,4'-bismaleimide is particularly suitably used because it exhibits good stability when dispersed in water and high cross-linking efficiency, as well as high heat resistance after cross-linking.

It is also possible to contain carbon black as a coating component. That is, the aqueous treating agent may further contain carbon black. The addition of carbon black may reduce the manufacturing cost of the reinforcing cord and effectively improve adhesiveness between the reinforcing cord and the matrix rubber.

In addition, carbon black is preferably a water dispersion in terms of homogeneous presence in the aqueous treating agent.

The aqueous treating agent may be combined with, in addition to the latex of the highly saturated nitrile rubber of the present invention, for example, butadiene styrene copolymer latex, dicarboxylated butadiene styrene copolymer latex, vinylpyridine butadiene styrene terpolymer latex, chloroprene latex, butadiene latex, chlorosulfonated polyethylene latex, acrylonitrile-butadiene copolymer latex, and so on. In addition, the latex may be a blend of the above examples.

It is also possible to contain peroxides as a coating component. That is, the aqueous treating agent may further contain peroxides. The addition of peroxides may accelerate cross-linking between coatings and the matrix rubber, resulting in further improved adhesiveness between the reinforcing cord and the matrix rubber. The peroxides used are not limited to a particular type. For example, organic peroxides such as hydroperoxides and dialkyl peroxides may be used. However, it is necessary to select such a peroxide that has an equivalent reaction rate as compared to the cross-linking agent contained in the matrix rubber. Among these, water-insoluble peroxides are preferably water dispersions in terms of homogeneous presence in the aqueous treating agent.

The above-described components of the aqueous treating agent, such as the latex, cross-linking agent and resorcin-formaldehyde condensate, are dispersed or dissolved in an aqueous solvent. As an aqueous solvent, a water solvent is suitably used that is easy to handle, facilitates controlling the concentration of the above-described components, and imposes a remarkably lower environmental load as compared to organic solvents. Additionally, the aqueous solvent may contain lower alcohol, and so on.

The aqueous treating agent may also contain other components, such as an inorganic filler other than carbon black, plasticizer, anti-oxidant, metal oxide, and so on.

There is no particular limitation on the way of applying the aqueous treating agent to reinforcing fibers and forming coatings. Normally, reinforcing fibers are immersed in a water tank containing an aqueous treating agent, then lifted up from the water tank and passed through a drying furnace to thereby remove the solvent. In addition, there is also no particular limitation on drying conditions for removing the solvent. For example, the solvent may be removed by being exposed to an atmosphere at a temperature of 80° C. to 160° C. for 0.1 to 2 minutes. For example, a predetermined number of the reinforcing fibers thus formed with coatings may be twisted together to fabricate a reinforcing cord. The number of twists may be set appropriately for the fibers used. In addition, twisting may be done in several times separately and in any direction without limitation, depending on the required diameter and specifications of the reinforcing cord. If twisting is conducted in two steps separately, it is better to prepare a strand by primarily twisting a number of reinforcing fibers together and then finally twisting a number of such strands together to form a cord.

In the reinforcing cord thus formed, the adhesion rate of coating is preferably 10 mass % to 30 mass % and more preferably 12 mass % to 22 mass %. If the adhesion rate is less than 10 mass %, it is difficult to cover the entire surfaces of the reinforcing fibers with the coatings. Alternatively, if the adhesion rate is greater than 30 mass %, a problem is likely to occur with drips of the aqueous treating agent when forming coatings, and furthermore, the resulting coatings will likely be so thick that the central and peripheral portions of the reinforcing fibers have different properties, and so on, which is also problematic. Additionally, the adhesion rate of coating (R) means the mass percentage indicating how much coatings are adhered in relation to the mass of the reinforcing fibers concerning the reinforcing cord after drying, which is given by the following formula:

$$R(\%)=((C1-C0)/C1)\times 100$$

where C0: dry mass of reinforcing fibers before coating, and

C1: dry mass of reinforcing fibers after coating.

A rubber product of the present invention will now be described below.

The rubber product of the present invention comprises the above-described reinforcing cord, which is formed to be embedded in a rubber composition (matrix rubber). One example of the rubber product is, e.g., a toothed belt as illustrated in FIG. 1. The toothed belt 1 illustrated in FIG. 1 contains a belt body 11 and reinforcing cords 12. The belt body 11 includes a belt portion 13 and a plurality of tooth portions 14 protruding from the belt portion 13 at constant intervals. The reinforcing cords 12 are arranged in the belt portion 13 in such a direction as to extend in the circumferential direction (longitudinal direction) of the belt portion 13, and embedded in the belt portion 13. The above-described reinforcing cord of the present invention is used as the reinforcing cord 12.

It should be noted that in manufacturing the rubber product of the present invention, any well-known means may be directly used as-is for embedding the reinforcing cord in the matrix rubber without any particular limitation. The rubber product thus obtained has high heat resistance resulting from the properties of the matrix rubber as well as high strength and high bending fatigue resistance resulting from the embedded reinforcing cord. Accordingly, this rubber product is particularly suitable for use in timing belts for vehicle engines, and so on.

Used as the matrix rubber to which the reinforcing cord of the present invention is embedded may be chloroprene rubber, chlorosulfonated polyethylene rubber, ethylene propylene rubber, hydrogenated nitrile rubber, and so on without any particular limitation. However, in consideration of adhesiveness, at least one rubber selected from, for example, hydrogenated nitrile rubber and hydrogenated nitrile rubber with a microdispersed zinc acrylate derivative is preferably used. Furthermore, alternatives may also include carboxyl-modified hydrogenated nitrile rubber.

The reinforcing cord treated with the aqueous treating agent of the present invention is excellent in both wear resistance and resistance to dynamic fatigue. In addition, since the highly saturated nitrile rubber of the present invention used in the latex has excellent oil resistance, heat resistance, and so on, the rubber product obtained by using the aqueous treating agent of the present invention is suitable for use as oil-contacting members for automobiles, particularly as belts, such as flat belts, V-belts, V-ribbed belts, round belts, square belts or toothed belts, and particularly suitable for in-oil belts.

EXAMPLES

The present invention will now be described in more detail below with reference to examples thereof. The parts and percentages are by weight unless otherwise indicated.

Properties were evaluated in the following way.

(1) Copolymer Composition

In this case, 100 g of latex is solidified with 1 L of methanol and then vacuum dried at 60° C. to obtain a rubber, which in turn is analyzed with 1H-NMR to determine its copolymer composition.

(2) Iodine Value

The iodine value of the rubber obtained in the same manner as item (1) above is measured in accordance with JIS K 6235.

(3) Tetrahydrofuran Insoluble Fraction

In this case, 15 g of a latex is placed in a petri dish made of polytetrafluoroethylene, dried in air at 25° C. for two days, and then vacuum dried at 40° C. for 24 hours to obtain 300 mg of a rubber. The obtained rubber is precisely weighed and placed in a basket made of 100-mesh stainless steel wire mesh, which in turn is immersed in 100 ml of tetrahydrofuran and left at rest at 25° C. for 48 hours. Subsequently, the basket is lifted from the tetrahydrofuran, dried in air, and then directly vacuum dried at 60° C. overnight. Any insoluble fractions remaining in the basket are precisely weighed and determined as a percentage (%) to the rubber weight before immersion in tetrahydrofuran.

(4) Tensile Strength Retention Ratio (%)

Figure 2:
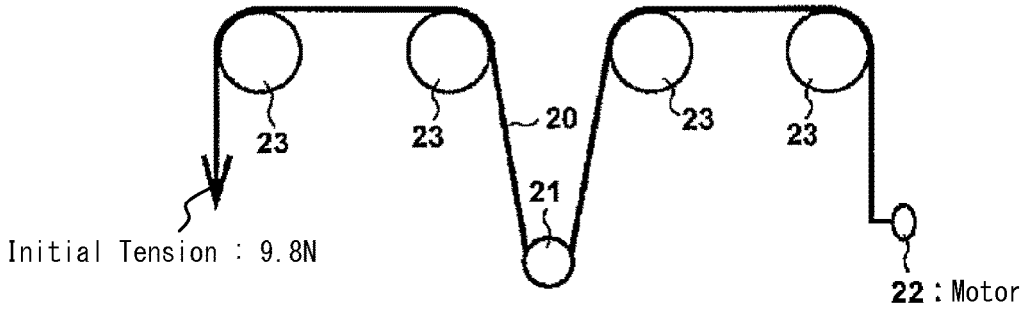
FIG. 2 is a diagram for explaining how to measure a tensile strength retention ratio.

A schematic diagram of the measurement method is illustrated in FIG. 2. A test specimen 20 having its one end fixed to a motor 22 is routed through one flat pulley 21 having a diameter of 25 mmϕ and four guide pulleys 23 of a flex testing machine. The test specimen 20 is moved back and forth by the motor 22 and repeatedly bent at those points where it runs along the flat pulley 21. The test specimen is bent 100,000 times at room temperature with the initial tension of 9.8 N and measured for its tensile strength (residual tensile strength) after being bent to evaluate bending fatigue properties thereof. A ratio to the tensile strength before the test (an initial tensile strength) is determined as a tensile strength retention ratio.

In addition, to evaluate oil-resistant performance, a sample is immersed in oil and measured for its tensile strength retention ratio by the flex testing machine. Oil used in evaluation is "10W-30 mineral oil for gasoline and diesel engines." This oil is set to a temperature of 120° C. and the sample is immersed therein to an extent that the flat pulley 21 in FIG. 2 is fully immersed, where the sample is bent 100,000 times to determine the tensile strength retention ratio as is the case with the above-described evaluation in air.

Example 1

(Preparation of Nitrile Rubber Latex (L1))

Fed to a metal container equipped with a stirrer were 180 parts of ion-exchanged water, 25 parts of an aqueous solution of sodium dodecyl benzene sulfonate at a 10% concentration, 37 parts of acrylonitrile, 8 parts of methacrylic acid, and 0.32 parts of a molecular weight modifier (t-dodecylmercaptan) in the stated order. Then, the gas inside the container was replaced three times with nitrogen gas, and 55 parts of butadiene was fed to the container.

The metal container was maintained at 5° C. and fed with 0.1 parts of a polymerization catalyst (cumene hydroperoxide). The mixture was subjected to polymerization reaction for 16 hours under stirring. After terminating the polymerization reaction by adding 0.1 parts of a polymerization terminator (an aqueous solution of hydroquinone at a 10% concentration), residual monomers were removed using a rotary evaporator at a water temperature of 60° C., a latex L1 (with a solid concentration of about 30%, and which may be hereinafter referred to simply as "nitrile rubber latex (L1)") of an acrylonitrile-butadiene-methacrylic acid copolymer rubber U1 (which may be hereinafter referred to simply as "nitrile rubber (U1)") having an acrylonitrile unit content of 37%, a butadiene unit content of 55% and a methacrylic acid unit content of 8% was obtained. The iodine value of the nitrile rubber (U1) was 258 as shown in Table 1.

(Preparation of Highly Saturated Nitrile Rubber Latex)

Polyvinyl pyrrolidone with a weight-average molecular weight of 5,000 was added as much as five times the amount of palladium to 300 L of an acidic aqueous solution of palladium catalyst obtained by adding nitric acid of a 5-fold molar equivalent relative to palladium to palladium acetate (used in an amount of 1,200 ppm at a ratio of Pd metal/nitrile rubber (U1)). An aqueous solution of potassium hydroxide was further added to prepare an aqueous solution of catalyst A at a pH of 9.0.

Then, 400 L of a nitrile rubber latex (L1) adjusted to a total solid content concentration of 30% (with a solid content of 120 kg) and the total amount of the aqueous solution of catalyst A were loaded into an autoclave equipped with a stirrer, through which nitrogen gas was allowed to flow for 10 minutes to remove the dissolved oxygen in the latex. After replacing the gas inside the system with hydrogen gas twice, hydrogen was pressurized to 3 MPa. The contents were heated to 50° C. and allowed to react for 6 hours, whereby a nitrile rubber hydrogenated mixture in latex state was obtained.

Then, 24 L of a 30% hydrogen peroxide solution was added to the above-described nitrile rubber hydrogenated mixture in latex state, which in turn was stirred (oxidized) at 80° C. for 2 hours. Then, this nitrile rubber hydrogenated mixture in latex state was adjusted to a pH of 9.5 and added with dimethylglyoxime as much as a 5-fold molar amount relative to the palladium contained in the aqueous solution of catalyst A, in which case the dimethylglyoxime was added directly in powder form to the mixture. The mixture was then heated to 80° C. and stirred for 5 hours, whereby an insoluble material was precipitated in the latex.

A white filtrate, which was obtained by removing the insoluble material from the latex, was concentrated under reduced pressure by a rotary evaporator, whereby a latex S1 (which may be hereinafter referred to as "highly saturated nitrile rubber latex (S1)) of hydrogenated nitrile rubber R1 (highly saturated nitrile rubber (R1)) with a solid content concentration of 40% was obtained. It was determined that the highly saturated nitrile rubber R1 has an iodine value of 22 and a copolymer composition similar to that of the above-described nitrile rubber (U1) (however, most of the double bonds of the butadiene unit are hydrogenated).

It was also determined that the highly saturated nitrile rubber R1 has a tetrahydrofuran insoluble fraction of 70 wt % as shown in Table 3.

Example 2

As shown in Table 4, 100 parts by weight of the highly saturated nitrile rubber latex (S1) of the present invention, 20 parts by weight of diphenylmethane-4,4-bismaleimide, 20 parts by weight of polyisocyanate and 10 parts by weight of carbon black were mixed and stirred at 25° C. for 30 minutes to obtain an aqueous treating agent composition (A1).

Example 3

Three glass fibers (each being a bundle of 200 filaments having an average diameter of 9 μm, E-glass composition) were aligned with one another to obtain a reinforcing fiber of 101 tex. The reinforcing fiber was immersed in the above-described aqueous treating agent composition (A1) and then dried in a drying furnace set at 150° C. for one minute to form a coating. Each of the glass fibers thus obtained with coatings formed thereon was primarily twisted at a rate of 8 times/10 cm, and 11 of primarily twisted reinforcing fibers were further aligned with one another and finally twisted at a rate of 8 times/10 cm to produce a reinforcing glass cord (C1). It was determined that the coating of the reinforcing glass cord has an adhesion rate of 20 mass %.

Additionally, these reinforcing cords may be formed with second coatings for improving the adhesiveness to the matrix rubber.

In this example, each reinforcing cord was applied with a halogen-containing-polymer-based adhesive (Chemlock 402, manufactured by Lord Corporation) and then dried in a drying furnace at 150° C. for one minute.

These reinforcing glass cords (C1) were embedded by well-known means in a matrix rubber containing the components at ratios shown in Table 5, thereby forming a flat belt (H1) of 10 mm wide, 300 mm long and 3 mm thick. The tensile strength retention ratio of the resulting flat belt (H1) is shown in Table 6. The result of evaluation in air showed bending resistance as high as 90%. The result of evaluation in oil also showed bending resistance as high as 88%, which is almost the same as that shown by the result of evaluation in air. It was thus found that the flat belt has high oil resistance.

Examples 4, 7, 10 and 13

Carboxyl group-containing nitrile rubber latexes (L2) to (L5) were obtained in the same manner as in Example 1, except for a change in the amount of the chain transfer agent used in polymerization as shown in Table 1 and a change in the composition of monomer as shown in Table 1 appropriately. Highly saturated nitrile rubber latexes (S2) to (S5) were obtained in the same manner as Example 1, except for the use of the carboxyl group-containing nitrile rubber latexes (L2) to (L5) in place of the carboxyl group-containing nitrile rubber latex (L2) and a change in the amount of the hydrogenation catalyst used as shown in Table 2. Table 3 shows the properties of the highly saturated nitrile rubbers (R2) to (R5) obtained from these latexes. In all examples, it was determined that the obtained highly saturated nitrile rubbers have an iodine value of not more than 30 and a tetrahydrofuran insoluble fraction of not less than 30 wt %.

Examples 5, 8, 11 and 14

Aqueous treating agent compositions (A2) to (A5) were obtained in the same manner as in Example 2, except for the use of the highly saturated nitrile rubber latexes (S2) to (S5) in place of the highly saturated nitrile rubber latex (S1).

Examples 6, 9, 12 and 15

Reinforcing glass cords (C2) to (C5) and flat belts (H2) to (H5) were obtained in the same manner as Example 3, except for the use of the aqueous treating agent compositions (A2) to (A5) in place of the aqueous treating agent composition (A1). It was determined that all adhesion rates of the coatings in the reinforcing glass cords are 20 mass %.

The tensile strength retention ratios of the resulting flat belts (H2) to (H5) are shown in Table 6. The results of evaluation in air all showed bending resistance as high as 85% or more. In addition, since the results of evaluation in oil and the results of evaluation in air differ by not more than 10% at most and the results of evaluation themselves are not less than 80%, all examples exhibited high oil resistance.

TABLE 1

| | Examples | | | | |
|---|---|---|---|---|---|
| | 1 | 4 | 7 | 10 | 13 |
| Weight Feed Monomer Composition | | | | | |
| Acrylonitrile (parts) | 37 | 37 | 37 | 34 | 44 |
| Butadiene (parts) | 55 | 55 | 55 | 60 | 48 |
| Methacrylic acid (parts) | 8 | 8 | 8 | 6 | 8 |
| t-dodecyl mercaptan (parts) | 0.32 | 0.28 | 0.45 | 0.32 | 0.42 |
| Polymerization conversion rate (%) | 90 | 90 | 90 | 90 | 90 |
| Nitrile Rubber Latex | L1 | L2 | L3 | L4 | L5 |
| Iodine Value | 258 | 258 | 258 | 281 | 225 |

TABLE 2

| | Examples | | | | |
|---|---|---|---|---|---|
| | 1 | 4 | 7 | 10 | 13 |
| Nitrile Rubber Latex | L1 | L2 | L3 | L4 | L5 |
| Amount of Hydrogenation Catalyst Used (×1,000 ppm) | 1.2 | 1.2 | 1.2 | 2.5 | 1.0 |
| Highly Saturated Nitrile Rubber Latex | S1 | S2 | S3 | S4 | S5 |

TABLE 3

| | Examples | | | | |
|---|---|---|---|---|---|
| | 1 | 4 | 7 | 10 | 13 |
| Highly Saturated Nitrile Rubber | R1 | R2 | R3 | R4 | R5 |
| Iodine Value | 22 | 26 | 27 | 4 | 30 |
| Tetrahydrofuran Insoluble Fraction (wt %) | 70 | 85 | 40 | 70 | 50 |

TABLE 4

| | Examples | | | | |
|---|---|---|---|---|---|
| | 2 | 5 | 8 | 11 | 14 |
| Highly Saturated Nitrile Rubber Latex | S1 | S2 | S3 | S4 | S5 |
| (parts by weight) | 100 | 100 | 100 | 100 | 100 |
| diphenylmethane-4,4-bismaleimide (parts by weight) | 20 | 20 | 20 | 20 | 20 |
| Polyisocyanate (parts by weight) | 20 | 20 | 20 | 20 | 20 |
| Carbon Black (parts by weight) | 10 | 10 | 10 | 10 | 10 |
| Aqueous Treating Agent Composition | A1 | A2 | A3 | A4 | A5 |

TABLE 5

| | parts by weight |
|---|---|
| Hydrogenated Nitrile Rubber (Zetpol 2020) | 70 |
| Hydrogenated Nitrile Rubber Containing Zinc Dimethacrylate (Zetpol 2000 L) | 30 |
| Zinc Oxide | 10 |
| Stearic Acid | 1 |
| Carbon Black | 30 |
| Trioctyl Trimellitate | 5 |
| Sulfur | 0.1 |
| 1,3-bis(t-butylperoxy-isopropyl)benzene | 6 |
| Magnesium Oxide | 1 |

TABLE 5-continued

| | parts by weight |
|---|---|
| 4,4-(α,α-dimethylbenzyl)diphenylamine | 0.5 |
| 2-Mercaptobenzimidazole Zinc Salt | 0.5 |
| Triaryl Isocyanurate | 1 |

TABLE 6

| | | Examples | | | | |
|---|---|---|---|---|---|---|
| | | 3 | 6 | 9 | 12 | 15 |
| Aqueous Adhesive Composition | | A1 | A2 | A3 | A4 | A5 |
| Reinforcing Glass Cord | | C1 | C2 | C3 | C4 | C5 |
| Flat Belt | | H1 | H2 | H3 | H4 | H5 |
| Tensile Strength Retention Ratio (%) | in air (room temperature) | 90 | 85 | 90 | 95 | 85 |
| | in oil (120° C.) | 88 | 82 | 80 | 94 | 80 |

Comparative Examples 1, 4, 7, 10 and 13

Carboxyl group-containing nitrile rubber latexes (LC1) to (LC5) were obtained in the same manner as in Example 1, except for a change in the amount of the chain transfer agent used in polymerization as shown in Table 7 and a change in the composition of monomer as shown in Table 7 appropriately.

Highly saturated nitrile rubber latexes (SC1) to (SC5) were obtained in the same manner as Example 1, except for the use of carboxyl group-containing nitrile rubber latexes (LC1) to (LC5) in place of the carboxyl group-containing nitrile rubber latex (L1) and a change in the amount of the hydrogenation catalyst used as shown in Table 8.

Table 9 shows the properties of the highly saturated nitrile rubbers (RC1) to (RC5) obtained from these latexes. The iodine value was not more than 30 in the comparative examples other than Comparative Example 4 (RC2), while the tetrahydrofuran insoluble fraction was less than 30 mass % in all of the comparative examples.

Comparative Examples 2, 5, 8, 11 and 14

Aqueous treating agent compositions (AC1) to (AC5) were obtained in the same manner as in Example 2, except for the use of the highly saturated nitrile rubber latexes (SC1) to (SC5) in place of the highly saturated nitrile rubber latex (S1).

Comparative Examples 3, 6, 9, 12 and 15

Reinforcing glass cords (CC1) to (CC5) and flat belts (HC1) to (HC5) were obtained in the same manner as Example 3, except for the use of the aqueous treating agent compositions (AC1) to (AC5) in place of the aqueous treating agent composition (A1). It was determined that all adhesion rates of the coatings in the reinforcing glass cords are 20 mass %.

The tensile strength retention ratios of the resulting flat belts (HC1) to (HC5) are shown in Table 11. The results of evaluation in air showed that the tensile strength retention ratios of the comparative examples, excluding HC5 of Comparative Example 15, are not less than 80%. It can thus be understood that these comparative examples have high bending resistance.

The reason why HC5 has a lower tensile strength retention ratio in air is because it does not involve methacrylic acid as a feed monomer composition when a nitrile rubber latex is prepared.

It can be seen that all of the comparative examples have a tensile strength retention ratio in oil of as low as 70% or less, assuming poor oil resistance.

TABLE 7

| | Comparative Examples | | | | |
|---|---|---|---|---|---|
| | 1 | 4 | 7 | 10 | 13 |
| Weight Feed Monomer Composition | | | | | |
| Acrylonitrile (%) | 37 | 37 | 34 | 34 | 26 |
| Butadiene (%) | 55 | 55 | 60 | 60 | 74 |
| Methacrylic acid (%) | 8 | 8 | 6 | 6 | 0 |
| t-dodecyl mercaptan | 0.65 | 0.65 | 0.50 | 0.50 | 0.65 |
| Polymerization conversion rate (%) | 90 | 90 | 90 | 90 | 90 |
| Nitrile Rubber Latex | LC1 | LC2 | LC3 | LC4 | LC5 |
| Iodine Value | 258 | 258 | 281 | 281 | 347 |

TABLE 8

| | Comparative Examples | | | | |
|---|---|---|---|---|---|
| | 1 | 4 | 7 | 10 | 13 |
| Nitrile Rubber Latex | LC1 | LC2 | LC3 | LC4 | LC5 |
| Amount of Hydrogenation Catalyst Used (×1,000 ppm) | 1.2 | 0.8 | 2.2 | 1.2 | 1.3 |
| Highly Saturated Nitrile Rubber Latex | SC1 | SC2 | SC3 | SC4 | SC5 |

TABLE 9

| | Comparative Examples | | | | |
|---|---|---|---|---|---|
| | 1 | 4 | 7 | 10 | 13 |
| Highly Saturated Nitrile Rubber | RC1 | RC2 | RC3 | RC4 | RC5 |
| Iodine Value | 22 | 45 | 4 | 25 | 25 |
| Tetrahydrofuran Insoluble Fraction (wt %) | 0 | 0 | 25 | 25 | 0 |

TABLE 10

| | Comparative Examples | | | | |
|---|---|---|---|---|---|
| | 2 | 5 | 8 | 11 | 14 |
| Highly Saturated Nitrile Rubber Latex (parts by weight) | SC1 | SC2 | SC3 | SC4 | SC5 |
| | 100 | 100 | 100 | 100 | 100 |
| Diphenylmethane-4,4-bismaleimide (parts by weight) | 20 | 20 | 20 | 20 | 20 |
| Polyisocyanate (parts by weight) | 20 | 20 | 20 | 20 | 20 |
| Carbon Black (parts by weight) | 10 | 10 | 10 | 10 | 10 |
| Aqueous Treating Agent Composition | AC1 | AC2 | AC3 | AC4 | AC5 |

TABLE 11

| | | Comparative Examples | | | | |
|---|---|---|---|---|---|---|
| | | 3 | 6 | 9 | 12 | 15 |
| Aqueous Adhesive Composition | | AC1 | AC2 | AC3 | AC4 | AC5 |
| Reinforcing Glass Cord | | CC1 | CC2 | CC3 | CC4 | CC5 |
| Flat Belt | | HC1 | HC2 | HC3 | HC4 | HC5 |
| Tensile Strength Retention Ratio (%) | in air (room temperature) | 86 | 80 | 90 | 85 | 75 |
| | in oil (120° C.) | 68 | 54 | 65 | 60 | 57 |

It can be seen from the results shown in Tables 6 and 11 that in a case where the highly saturated nitrile rubber of the latex used in the coating of the reinforcing cord has a so small tetrahydrofuran insoluble fraction that deviates from the scope of the present invention (less than 30 wt %), the rubber product using the reinforcing cord has poor oil resistance. In contrast, a rubber product that uses a glass cord for reinforcing rubber, which is formed with a coating by means of the highly saturated nitrile rubber of the present invention with a predetermined tetrahydrofuran insoluble fraction, has excellent oil resistance.

While the embodiments of the present invention have been described with reference to examples thereof, the present invention is not limited to the disclosed embodiments, but is applicable to other embodiments based on the technical ideas of the present invention.

REFERENCE SIGNS LIST

1 Toothed belt
11 Belt body
12 Reinforcing cord
20 Test specimen
21 Flat pulley
22 Motor
23 Guide pulley

The invention claimed is:

1. A reinforcing cord for rubber product comprising:
a reinforcing fiber; and
a coating on the surface of the reinforcing fiber,
wherein the coating contains:
a latex of a highly saturated nitrile rubber having an acrylonitrile content of 34 wt % to 44 wt %, a methacrylic acid content of 6 wt % to 8 wt %, an iodine value of 120 or less, and a tetrahydrofuran insoluble fraction of 30 wt % or more;
cross-linking agents comprising diphenylmethane-4,4'-bismaleimide and polyisocyanate; and
a resorcin-formaldehyde condensate.

2. The reinforcing cord according to claim 1, wherein the coating further contains carbon black.

3. The reinforcing cord according to claim 1, wherein the coating further contains an inorganic filler other than carbon black.

4. A rubber product comprising:
a matrix rubber; and
a reinforcing cord embedded in the matrix rubber,
wherein the reinforcing cord is the reinforcing cord according to claim 1.

* * * * *